US008121332B2

(12) United States Patent
Johnson

(10) Patent No.: US 8,121,332 B2
(45) Date of Patent: Feb. 21, 2012

(54) MICROPHONE MOUNT FOR A CABINET

(75) Inventor: Eric Johnson, Wood Village, OR (US)

(73) Assignee: Audix Corporation, Wilsonville, OR (US)

( * ) Notice: Subject to any disclaimer, the term of this patent is extended or adjusted under 35 U.S.C. 154(b) by 936 days.

(21) Appl. No.: 12/113,886

(22) Filed: May 1, 2008

(65) Prior Publication Data

US 2009/0274330 A1 Nov. 5, 2009

(51) Int. Cl.
*H04R 9/08* (2006.01)

(52) U.S. Cl. ..... 381/361; 381/362; 381/366

(58) Field of Classification Search ..... 381/355, 381/361, 362, 363, 365, 366, 368
See application file for complete search history.

(56) References Cited

U.S. PATENT DOCUMENTS 4,791,674 A * 12/1988 Drever ..... 381/368
6,720,490 B1 * 4/2004 Bruce ..... 84/327
7,390,950 B2 * 6/2008 Hollander ..... 84/453
7,446,255 B2 * 11/2008 Yamaya ..... 84/731

* cited by examiner

*Primary Examiner* — Victor A Mandala
*Assistant Examiner* — Scott Stowe
(74) *Attorney, Agent, or Firm* — Hancock Hugley LLP

(57) ABSTRACT

A microphone mount for mounting a microphone adjacent a speaker housed in a cabinet is defined by an elongate body having gripping fingers on opposite ends. The body is extendable and an elastic cord housed in the body normally pulls the gripping fingers together so that the mount may be extended and retained on a cabinet. A microphone interface is attached to one end of the body, which allows the user to position the microphone in any desired position relative to the speaker.

18 Claims, 2 Drawing Sheets

26
48
50
52
76
54
22
y
10
64
30
24
56
58
36
38
40
44
34
x
46
60
68
66
80

MICROPHONE MOUNT FOR A CABINET

FIELD OF THE INVENTION

This invention relates to devices used by musicians and other performers to mount microphones to other equipment, and more particularly, to an apparatus for mounting a microphone to a speaker cabinet so the microphone is maintained in desired proximity to loudspeakers in the cabinet.

BACKGROUND

Musicians and other performers often use microphones to amplify sound from loudspeakers. While there are a myriad of different cabinets and microphones, typically the microphone is mounted in a clip that is attached to a tripod, and the tripod is placed in front of the cabinet. The tripod may include a flexible gooseneck to assist with positioning of the microphone adjacent the speaker housed in the cabinet, but in any case the musician adjusts the position of the tripod so that the microphone is maintained close to the speaker so that it accurately amplifies the sound.

In many cases there are numerous electrical cords and microphone cables scattered around a stage. This is particularly true where a multi-performer band is playing on stage, where each musician may have multiple instruments, microphones, cabinets and other powered equipment. Numerous cords running around a stage can present all sorts of problems, including tripping hazards. A very common problem occurs with microphones set up on tripods in front of cabinets: performers and others on the stage often trip on the cables or kick them enough to dislodge the tripod so that the microphone is positioned incorrectly relative to the speaker. Tripping can be dangerous to the performer, and improperly positioned microphones degrade the sound quality.

The present invention is a microphone mounting device that is designed to adapt to a cabinet so that a microphone is held in desired proximity to loudspeakers, and so that cables associated with the microphone may be kept out of the way of performers as they move around a stage. The microphone mount of the present invention is defined by an elongate body with arms that grip the cabinet—the body may be extended and retracted to vary the length of the body between the arms. An interface at one end of the body allows a microphone to be positioned adjacent a speaker housed in the cabinet.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF THE PREFERRED EMBODIMENTS

Figure 1:
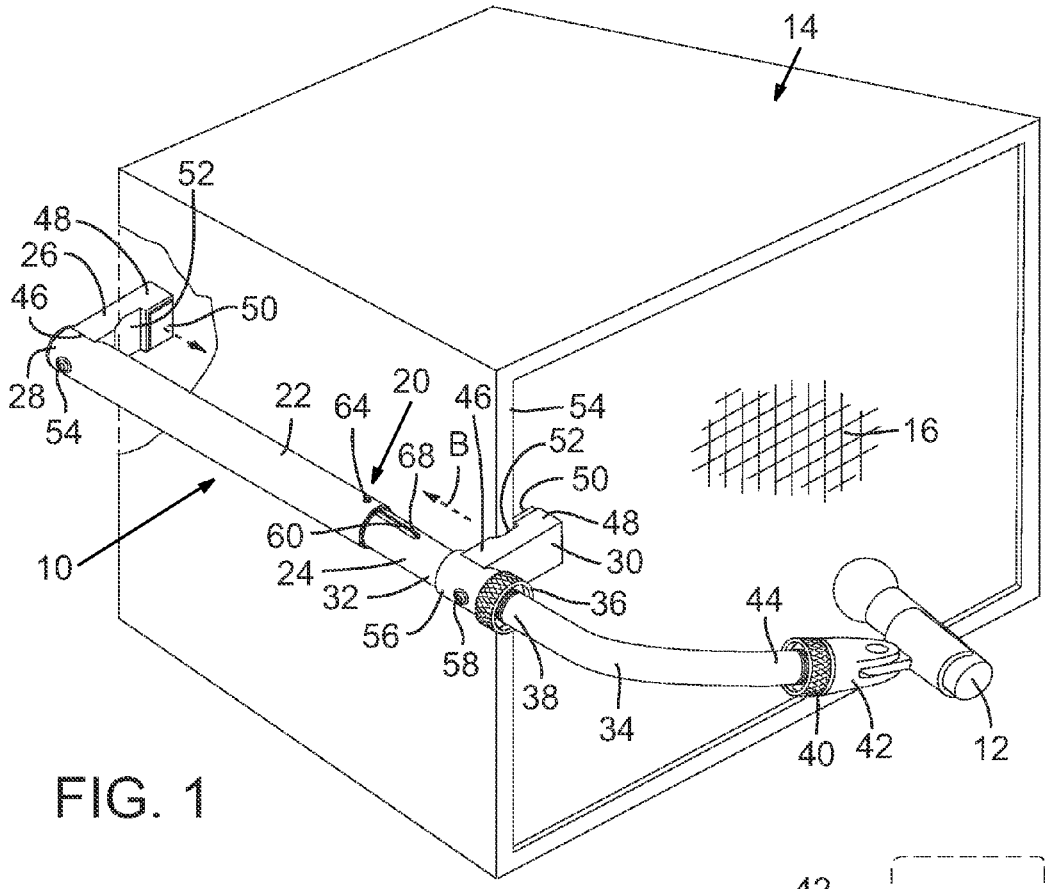
FIG. 1 is a perspective view of a microphone mount according to the present invention attached to a speaker cabinet.

A microphone mount 10 according to the present invention will now be described with reference to the drawings. As best shown in FIG. 1, microphone mount 10 is used to position a microphone 12 adjacent a speaker cabinet 14. It will be understood that cabinet 14 houses one or more loudspeakers, which are not shown in FIG. 1 but which are positioned in a conventional manner behind the speaker grill 16. There are two basic types of cabinets, those having amplifiers housed in the cabinet along with the loudspeakers, and those having separate amplifiers. And within those two general categories of cabinets, there are innumerable shapes for the cabinet housings. The cabinet 14 shown in FIG. 1 utilizes a typical box-shaped cabinet. Microphone mount 10 is designed to adapt to most commercially available cabinets, regardless of the configuration of the particular housing used. The mount may be used with wireless microphones as shown in FIG. 1, but more typically is used with microphones that use standard cabling.

Microphone mount 10 is defined by an elongate main body 20, which in turn comprises an outer tube 22 and an inner tube 24 that, as detailed below, is elastically and slidingly telescopic in outer tube 22. Main body 20 defines a longitudinal axis, and as detailed below, the length of main body 20 may be varied to accommodate a variety of cabinet shapes and sizes. Main body 20 has a first arm 26 that extends transversely relative to the longitudinal axis from a first end 28 of main body 20, and a second arm 30 that extends transversely relative to the longitudinal axis from a second end 32 of the main body. A microphone interconnect 34 is removably attached to the second end 32 with a threaded lock nut 36, which is placed at the first end 38 of the interconnect 34. A similar threaded lock nut 40 attaches a microphone clip 42 to the second end 44 of the interconnect. Microphone 12 is removably attached to microphone clip 42. Microphone interconnect 34 is a length of tubing that has an approximately 90° bend midway along its length so that the microphone is positioned adjacent the speaker in the cabinet. The interconnect defines a microphone positioning mechanism that allows variability in the position of the microphone 12 adjacent or proximate to the cabinet. It should be understood that the manner in which microphone 12 is attached to the microphone clip, and the manner in which the microphone clip is attached to the microphone interconnect 34 are not particularly important to the invention defined in the claims, and that there are numerous equivalent structures that may be used in place of these components.

Figure 2:
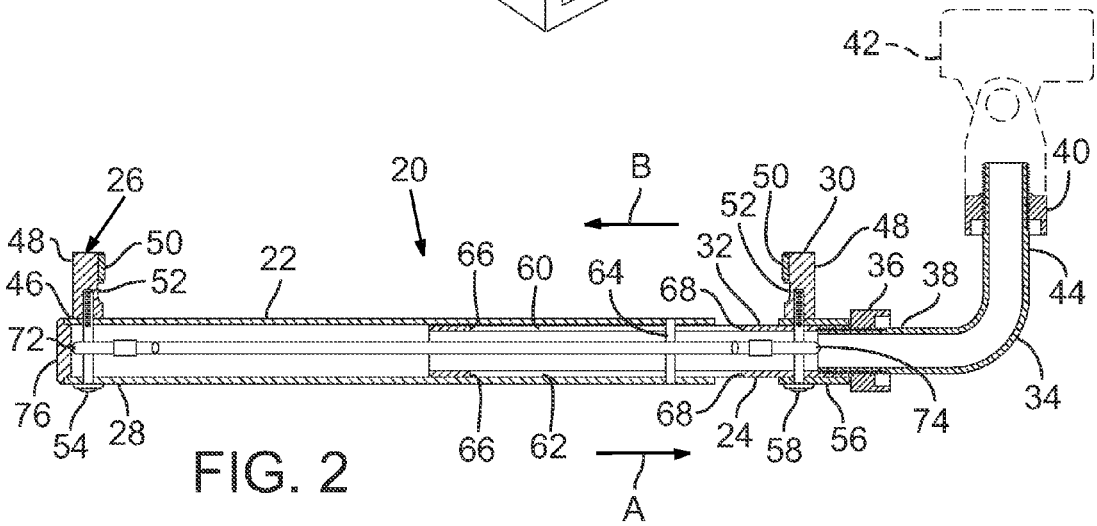
FIG. 2 is a cross sectional view taken longitudinally along the length of the microphone mount illustrated in FIG. 1, showing the microphone clip in phantom lines.

With reference now to FIG. 2, first and second arms 26 and 30 are essentially identical in construction and have a base portion 46 that is configured to attach the arms to the main body 20. In the case of the microphone mount 10 illustrated herein, in which the main body is cylindrical, the base portion 46 is a semi-circular portion that has a radius approximately the same as the radius of the outer periphery of the main body. The distal portion 48 of the arms 26 and 30 has a gripping member 50, preferably a soft material such as rubber that tends to grip the cabinet 14. A notch 52 may be formed in the middle section of the arms to accommodate a peripheral edge 54 of a cabinet such as shown in FIG. 1.

Arm 26 is attached to or near first end 28 of outer tube 22 of main body 20 with a screw 54 that extends through bores formed in the outer tube—the threaded portion of the screw 54 threads into a threaded bore formed in the base portion 46 of the arm. Second arm 30 is attached to an adaptor 56 that has an outer circumference the same as the outer circumference of outer tube 22 and which fits over the second end 32 of inner tube 24 of main body 20. A screw 58 extends through aligned bores formed through adaptor 56 and inner tube 24 and is threaded into the threaded bore in the base portion 46 of the arm to secure the arm to the adaptor and main body. When the arms 26 and 30 are attached to the main body, the gripping members are oriented so that they face one another. Of course, the position of the arms on the inner and outer tubes is somewhat variable so long as the arms are separable when the tubes are slid relative to one another.

Both outer tube 22 and inner tube 24 are cylindrical and the inner diameter of the outer tube is slightly greater than the outer diameter of the inner tube. As such, inner tube may be inserted into the outer tube, and the inner tube is longitudinally and axially slidable in the outer tube. A pair of diametrically opposed longitudinal slots 60 and 62 is cut into inner tube 24. When the inner and outer tubes 22 and 24 are assembled as shown in FIG. 2, a pin 64 is inserted through bores in the outer tube and through the slots 60 and 62. Pin 64 thus functions as a keeper that maintains the relative orientation between the inner and outer tubes as the mount is moved between extended and retracted positions. This insures that the arms 26 and 30 always extend away from the mount on the same side of the main body 20. The proximate ends 66 of slots 60 and 62, and the distal ends 68 of the slots, define stops. Thus, assembled as shown in FIG. 2, inner tube 24 is longitudinally slidable in outer tube 22 to increased the length of microphone mount 10 (arrow A in FIG. 2) until pin 64 abuts the proximate ends 66 of slots 60, 62. Pin 64 thus acts as stop that prevents inadvertent removal of inner tube 24 from outer tube 22. Conversely, inner tube 24 is longitudinally slidable in outer tube 22 to decrease the length of the microphone mount (arrows B in FIGS. 1 and 2) until pin 64 abuts the proximate ends 68 of slots 60 and 62.

An elastic cord 70 is contained in main body 20 and has one end 72 attached to screw 54 and the opposite end 74 attached to screw 58. The elastic cord is sized so that when microphone mount 10 is in a resting position—that is, when pin 64 is abutting ends 68—the cord is under slight tension to retain the inner tube in a retracted position in which pin 64 is abutting the proximate ends 68 of slots 60 and 62. It will be appreciated that as inner tube 22 is moved in the direction of arrow A in FIG. 2, elastic cord 70 is stretched, placing the cord under tension. Accordingly, at all times elastic cord is exerting pulling force on inner tube 22, pulling the inner tube in the direction illustrated with arrows B. It will be appreciated that there are many equivalent structures that may be used to attach an elastic cord to the inner and outer tubes, and that there are many kinds of elastic cord that may be utilized with this invention. A cap 76 is added to the first end 28 of outer tube 24 to provide a finished appearance.

The inner surface of second end 24 of inner tube 22 is threaded, as is the first end 38 of microphone interconnect 34. Threaded nut 36 is threaded onto the first end 38 of the interconnect 34, and the nut 36 is then threaded into the threaded inner surface of adaptor 56 to lock the interconnect relative to main body 20. The rotational position of the interconnect 34 relative to main body 20 may be changed by loosening threaded lock nut 36, rotating the interconnect to the desired position, and then tightening the nut. The microphone clip 42 and the second end 44 of interconnect 34 is attached to the interconnect in a similar, conventional manner. It will be appreciated that pin 64 extending through slots 60 and 62 prevents inner tube 24 from axially rotating relative to outer tube 22, and thus maintains the positions of arms 26 and 30 relative to one another. It will also be appreciate that other geometrically shaped inner and outer tubes may be used in place of the circular shaped tubes shown in FIG. 1. For example, tubes having square or triangular cross sectional shapes may be used, in which case a pin would not be necessary to prevent relative axial rotation—so long as the tubes had like cross sectional configurations the smaller of the tubes will be longitudinally slidable within the relatively larger tube. The pin 64 used with round tubes, or other geometrically shaped tubes, thus define means for preventing relative axial rotation of the tubes.

The components described above are shown in an exploded view in FIG. 3, illustrating the manner in which the components are assembled.

Figures 3, 4, 5, 6:
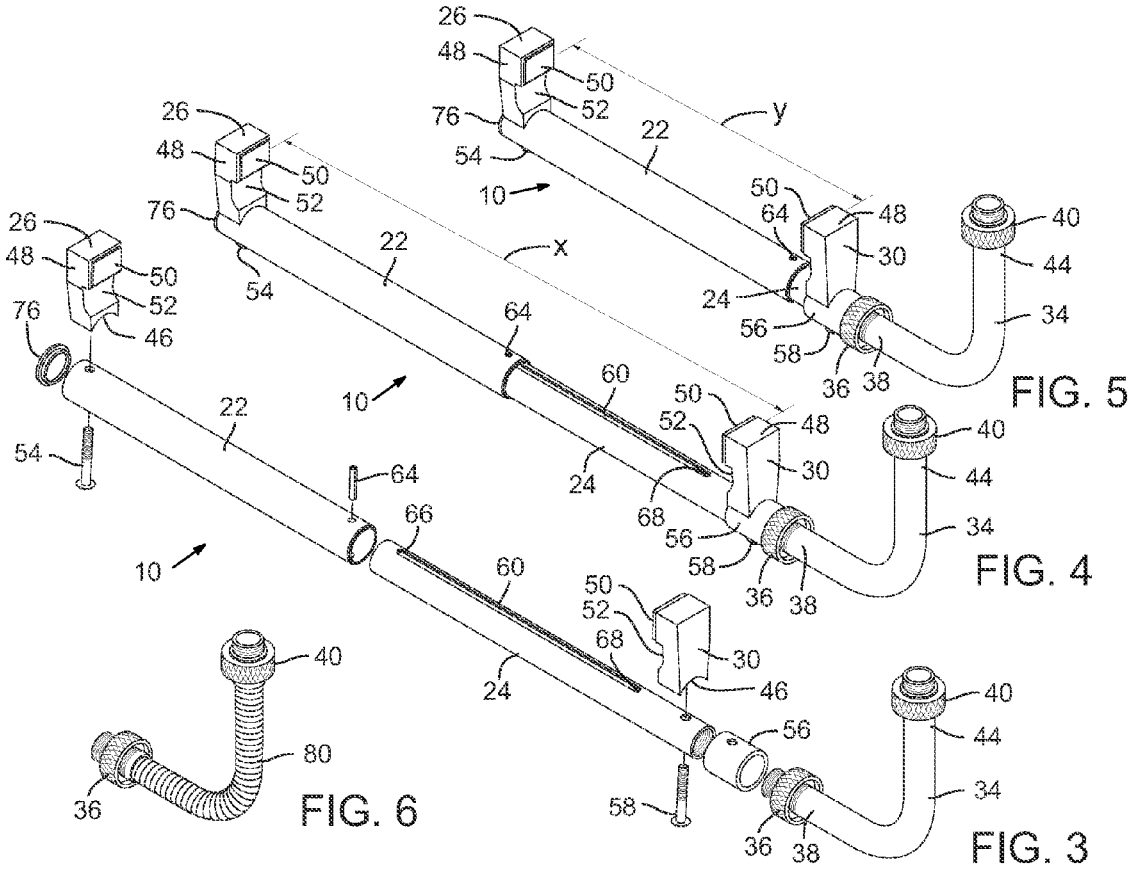
FIG. 3 is a perspective exploded view of the microphone mount according to the present invention, omitting the elastic cord housed in the body.
FIG. 4 is a perspective view similar to the view of FIG. 3, but showing the assembled microphone mount in an extended position.
FIG. 5 is a perspective view similar to the view of FIG. 4, illustrating the assembled microphone mount in a retracted position.
FIG. 6 is a perspective view of an alternative embodiment of the microphone interconnect portion of the microphone mount shown in FIG. 5.

The overall length of microphone mount 10 between arms 26 and 30 may be varied so that the mount may be attached to most commercially available cabinets. In FIG. 4 the inner tube 24 has been extended away from the outer tube 22 so the mount is in an extended position and the distance between arms 26 and 30 is shown as distance X. Of course, in this position there is a significant tension applied to inner tube 24 by elastic cord 70 (not shown in FIG. 4), pulling the inner tube and thus arm 30 into the retracted position shown in FIG. 5, where the distance between the arms is shown as distance Y. And as noted above, even in the fully retracted position of FIG. 5, there is preferably some tension applied to the inner tube by the elastic cord.

To attach microphone mount 10 to a cabinet 14, the inner tube is pulled outwardly to an extended position (FIG. 4) such that the distance X between arms 26 and 30 is slightly greater than the depth of the cabinet to which the mount is being attached. The extended mount is then positioned over the front and rear edges of the cabinet and the mount is allowed to retract. The elastic cord applies pressure to the arms 26 and 30 and the gripping pads 50 increase the holding strength of the mount as the arms rest against surfaces of the cabinet. In many cases, as shown in FIG. 1, the cabinet will have raised peripheral edge portions that fit nicely into the notches 52 in the arms.

An alternative embodiment of a microphone interconnect 34 according to the present invention is shown in FIG. 6. In this embodiment, microphone interconnect 80 is defined by a flexible arm that allows for enhanced ability to position the microphone adjacent the cabinet. It will be appreciated that in addition to the flexible gooseneck type of arm 80 shown in FIG. 6, and the bent arm 34 in FIGS. 1 through 5, there are numerous other structures that may be used to attach a microphone to the microphone mount main body, and to allow positioning of the microphone adjacent the cabinet.

It will be appreciated by those of skill in the art that the microphone mounts described above may be modified in certain equivalent respects without departing from the scope of the invention. As one example, the main body may be defined by flat rods that are movable relative to one another as opposed to tubular members that have like cross sectional configurations. As another example of an equivalent apparatus, the elastic cord could be replace with a mechanism such as a thumb screw that fixes the position of the inner and outer tubes relative to one another, and thus defines means for fixing the length of the mount body between the two arms. These and other modifications are contemplated by the invention.

While the present invention has been described in terms of a preferred embodiment, it will be appreciated by one of ordinary skill that the spirit and scope of the invention is not limited to those embodiments, but extend to the various modifications and equivalents as defined in the appended claims.

I claim:

1. Apparatus for mounting a microphone to a cabinet, comprising:

an elongate body having a tubular first portion and a second portion longitudinally slidable relative to and in the interior of the tubular first portion, a first arm attached to and extending transversely from the tubular first portion, and a second arm attached to and extending transversely from the second portion, said first and second arms oriented relative to the elongate body portion in a desired aligned orientation;

a pin having opposite ends attached to the tubular first portion so the pin spans the interior of the tubular first portion and extends through a slot cut in the second portion;

an elastic cord in the elongate body and having a first end attached to the tubular first portion and a second end attached to the second portion, said second portion slidable relative to the tubular first portion to increase the length of the elongate body between the first and second arms, wherein when the second portion is slid longitudinally relative to the tubular first portion, the pin rides in the slot to maintain the orientation between the first and second arms; and a microphone positioning member attached to the second portion.

2. The apparatus according to claim 1 wherein the first and second portions have similar cross sectional configurations.

3. The apparatus according to claim 2 wherein the tubular first portion and second portion are cylindrical in cross section and the outer diameter of the second portion is less than the inner diameter of the tubular first portion so that the second portion is longitudinally slidable in the tubular first portion.

4. The apparatus according to claim 3 wherein when said second portion is slid longitudinally relative to said tubular first portion to increase the length of said elongate body, said pin defines a stop to prevent the second portion from being removed from said tubular first portion.

5. The apparatus according to claim 4 wherein when said elongate body is in an extended position the elastic cord is under tension.

6. The apparatus according to claim 5 wherein the microphone positioning member is further defined by an arm attached to a distal end of the second portion of the elongate body, and a microphone clip attached to a distal end of said arm, wherein said arm is movable relative to said elongate body for selective positioning of a microphone attached to the microphone clip.

7. The apparatus according to claim 6 wherein the arm is flexible.

8. Apparatus for mounting a microphone to a cabinet, comprising: an elongate body, said body defining a longitudinal axis and having a first end and a second end; a first arm attached to the elongate body proximate the first end and extending from the elongate body in a direction generally transverse to the longitudinal axis; a second arm attached to the elongate body proximate the second end and extending from the elongate body in a direction generally transverse to the longitudinal axis; extension means for extending the length of the elongate body between the first arm and the second arm; tensioning means for applying tension to the elongate body so that the second arm is drawn under tension toward the first arm; and a microphone positioning member attached to the elongate body.

9. The apparatus according to claim 8 wherein the extension means is defined by the elongate body having a first elongate portion and a second elongate portion, the second elongate portion longitudinally movable relative to the first elongate portion, and wherein the first arm is attached to the first elongate portion and the second arm is attached to the second elongate portion.

10. The apparatus according to claim 9 wherein the tensioning means is defined by an elastic cord attached to the first elongate portion and the second elongate portion.

11. The apparatus according to claim 10 movable between an extended position and a retracted position, wherein the distance between the first and second arms in the extended position is greater than the distance between the first and second arms in the retracted position.

12. The apparatus according to claim 11 wherein the elastic cord applies tension to the second elongate portion.

13. The apparatus according to claim 12 including arm orientation means for maintaining the orientation of the first and second arms relative to one another as the elongate body is moved between the extended and retracted positions.

14. The apparatus according to claim 13 including microphone attachment means for attaching a microphone to the elongate body and for positioning the microphone in a desired position relative to the cabinet.

15. The apparatus according to claim 14 wherein the microphone attachment means is defined by an arm attached to a distal end of the second elongate portion of the elongate body, and a microphone clip attached to a distal end of said arm, wherein said arm is movable relative to said elongate body for selective positioning of a microphone attached to the microphone clip.

16. The apparatus according to claim 15 wherein the arm is flexible.

17. A method for positioning a microphone in a desired position relative to a speaker housed in a cabinet, comprising the steps of:

a) attaching a microphone to a distal end of an elongate member, said elongate member having a longitudinal axis and first and second elongate sections slidable relative to one another along the longitudinal axis and interconnected with an elastic member having a first end attached to the first elongate section and a second end attached to the second elongate section, and first and second arms extending transverse to the longitudinal axis, the first arm attached to the first elongate section and the second arm attached to the second elongate section;

b) extending the length of the elongate member by sliding the second elongate section relative to the first elongate section so that the separation distance between the first and second arms is greater than the width of the cabinet where the elongate member is to be attached; and c) attaching the elongate member to the cabinet by moving the first and second arms over the cabinet and retracting the length of the elongate member so that the arms bear against respective surfaces of the cabinet; and d) with the elastic member, applying continuous tension in the direction of the longitudinal axis between the first and second arms so that the second arm is continuously drawn under tension toward the first arm to maintain the attachment of the elongate member to the cabinet.

18. The method according to claim 17 wherein step c includes the step of applying pressure against the surfaces of the cabinet through the arms.

* * * * *